US009427124B2

(12) United States Patent
McLuckie et al.

(10) Patent No.: US 9,427,124 B2
(45) **Date of Patent: *Aug. 30, 2016**

(54) VACUUM CLEANER

(71) Applicant: Dyson Technology Limited, Malmesbury, Wiltshire (GB)

(72) Inventors: Paul Andrew McLuckie, Malmesbury (GB); Stuart Lloyd Genn, Malmesbury (GB); Jeremy William Crouch, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 438 days.

This patent is subject to a terminal disclaimer.

(21) Appl. No.: 13/917,419

(22) Filed: Jun. 13, 2013

(65) Prior Publication Data

US 2013/0333155 A1 Dec. 19, 2013

(30) Foreign Application Priority Data

Jun. 14, 2012 (GB) ..... 1210604.3

(51) Int. Cl.
*A47L 9/10* (2006.01)
*A47L 9/16* (2006.01)

(52) U.S. Cl.
CPC ..... *A47L 9/10* (2013.01); *A47L 9/165* (2013.01); *A47L 9/1608* (2013.01); *A47L 9/1658* (2013.01)

(58) Field of Classification Search
CPC ..... A47L 9/1683; A47L 5/28; A47L 9/1666; A47L 9/1691; A47L 9/127; A47L 9/16
See application file for complete search history.

(56) References Cited

U.S. PATENT DOCUMENTS

| | | | | |
|---|---|---|---|---|
| 2008/0047091 | A1* | 2/2008 | Nguyen | 15/300.1 |
| 2010/0263163 | A1* | 10/2010 | Han | 15/353 |
| 2011/0056045 | A1* | 3/2011 | Sepke | A47L 5/28 15/347 |
| 2011/0219572 | A1* | 9/2011 | Conrad | 15/347 |
| 2012/0180255 | A1 | 7/2012 | Park et al. | |
| 2013/0333156 | A1* | 12/2013 | McLuckie | A47L 5/30 15/353 |
| 2014/0053368 | A1* | 2/2014 | Gammack et al. | 15/353 |

FOREIGN PATENT DOCUMENTS

| | | |
|---|---|---|
| GB | 2 453 760 | 4/2009 |
| GB | 2469708 | 10/2010 |

(Continued)

OTHER PUBLICATIONS

Search Report dated Sep. 26, 2012, directed to GB Patent Application No. 1210604.3; 1 page.

*Primary Examiner* — Robert Scruggs
(74) *Attorney, Agent, or Firm* — Morrison & Foerster LLP

(57) ABSTRACT

A vacuum cleaner comprises a removable dust separator. The dust separator has an inlet duct and an outlet duct. The inlet duct is arranged for fluid connection to a dirt-air duct on the cleaner, and the outlet duct is arranged for fluid connection to a motor intake duct on the cleaner. In accordance with the invention, the inlet duct and outlet duct share a common wall which divides the open ends of the ducts, an inlet duct sealing member is provided for forming an air-seal between the inlet duct and the dirty-air duct, and an outlet duct sealing member is provided for forming an air seal between the outlet duct and the motor intake duct. Both seals are thus required to fail in order to short-circuit the two dirty-air duct and the motor intake duct, despite there being a common wall section between the inlet duct and the outlet ducts.

8 Claims, 5 Drawing Sheets

(56) References Cited

FOREIGN PATENT DOCUMENTS

| | | |
|---|---|---|
| JP | 1-181829 | 7/1989 |
| JP | 5-68659 | 3/1993 |
| JP | 2589338 | 3/1997 |
| JP | 2002-51952 | 2/2002 |
| JP | 2003-190061 | 7/2003 |
| JP | 2008-36063 | 2/2008 |

* cited by examiner

PRIOR ART

VACUUM CLEANER

REFERENCE TO RELATED APPLICATIONS

This application claims the priority of United Kingdom Application No. 1210604.3, filed Jun. 14, 2012, the entire contents of which are incorporated herein by reference.

FIELD OF THE INVENTION

The present invention relates to the field of cyclonic vacuum cleaners, and in particular vacuum cleaners which comprise a removable dust separator. The dust separator itself may be cyclonic or it may be bagged. The vacuum cleaner may be an upright vacuum cleaner or it may be some other type of cleaner (cylinder, handheld, stick vac cleaner etc.).

BACKGROUND OF THE INVENTION

Cyclonic vacuum cleaners work using cyclonic action to separate out dust and dirt from the dirty air sucked into the cleaner. They generally comprise at least one cyclonic chamber in which the air spins at high speed under the prevailing vacuum pressure, and a respective dirt collection chamber which is arranged to collect the dirt flung out from this fast-spinning airflow. The cyclone chamber and dirt collection chamber are together referred to as a cyclonic stage of separation.

The separation efficiency of a cyclonic stage varies with particle size. Consequently, in order to deal with the range in particles sizes typically found in household dust, a tuned series of cyclonic stages is typically provided. In this sort of multi-stage arrangement, the first stage tends to remove the relatively large particles and then each successive stage is optimized to remove successively smaller particles. The various stages may be packaged together as a single, cyclonic separator, which may be removable from the vacuum cleaner to allow easy emptying of the dirt collection chambers. FIG. 1 shows a typical example of this sort of general arrangement. Here, the vacuum cleaner 1 is an upright vacuum cleaner and a removable multi-stage cyclonic separator 3 is mounted in an upright position on a rolling support assembly 5 forming part of the cleaner 1.

FIG. 2 is a section through the cyclonic separator 3. Here the first cyclonic stage—or 'primary'—comprises a relatively large, cylindrical bin 7 which acts both as a cyclone chamber and as a dirt-collection chamber. The second cyclonic stage comprises a plurality of smaller, tapered cyclone chambers 9 arranged in parallel (to reduce pressure losses across the secondary stage) which each feed into a second dirt collection chamber 11—the so-called Fine Dust Collector (FDC).

The dirty air enters the cyclonic separator 3 through a tangential inlet 13 on the bin 7 (shown in FIG. 1), which helps impart the necessary spin to the airflow inside the bin 7. The air exits then exits the primary through a cylindrical mesh outlet—or 'shroud'—15 and from here is ducted to the secondary cyclone stage. The air exits the secondary cyclone chambers 9 through the top and is collected in a manifold 17, from where it ducted down through the bottom of the cyclonic separator 3—via a sock filter 19 (for separating very fine particles remaining in the airflow)—to the vac-motor.

SUMMARY OF THE INVENTION

According to the present invention there is provided a vacuum cleaner comprising a removable dust separator, the dust separator comprising an inlet duct and an outlet duct, the inlet duct being arranged for fluid connection to a dirty-air duct on the cleaner, and the outlet duct being arranged for fluid connection to a motor intake duct on the cleaner, the inlet duct and outlet duct sharing a common wall which divides the open ends of the ducts, an inlet duct sealing member being provided for forming an air-seal between the inlet duct and the dirty-air duct, and an outlet duct sealing member being provided for forming an air seal between the outlet duct and the motor intake duct.

In the arrangement of the present invention, the inlet duct and outlet duct are arranged so that they share a common wall. This is an efficient way of packaging the inlet duct and outlet duct in the cyclonic separator.

A potential drawback which has been identified with the use of a common wall separating the open ends of the ducts is that air can leak across the common wall between the two ducts, effectively short-circuiting the dirty-air duct to the motor intake duct. Consequently, dirty-air may be drawn in through the motor intake duct, risking damage to the motor.

The arrangement of the present invention addresses the problem of dirt ingress into the motor by providing two independent seals: an inlet duct sealing member for forming an air-seal between the inlet duct and the dirty-air duct, and an outlet duct sealing member which forms an air-seal between the outlet duct and the motor intake duct. In other words, there is a common wall section between the ducts, but not a common air-seal. Consequently, failure of either one of the sealing members does not necessarily create a short circuit between the ducts, despite the common wall section between the ducts. As a result, the risk of damage to the motor caused by dust ingress is significantly reduced.

The motor intake duct may be arranged in accordance with another aspect of the present invention so that it connects directly to atmosphere across the air-seal formed by the outlet duct sealing member. Consequently, this creates a leakage path from atmosphere directly into the motor intake duct in the event of failure of the air-seal. The leakage path bypasses the cyclonic separator altogether: in effect, the motor intake short-circuits to atmosphere if the duct sealing member fails. There is no closed path between the motor intake duct and the dirty air duct, across the air-seal formed by the outlet duct sealing member. Ingress of fine dust from the dirty-air duct into the motor intake is significantly reduced, even if both sealing members fail.

The open end of the outlet duct may be arranged to fit over the end of the motor intake duct in order to form a bypass leakage channel between the walls of the ducts, which channel connects the motor intake duct to atmosphere. This is a convenient arrangement for connecting the motor intake duct to atmosphere and the outlet duct also advantageously cowls the entrance to the motor intake duct. In this arrangement, the motor intake duct can also be extended a considerable distance up inside the outlet duct, if desired.

The duct sealing member may be arranged so that it sits inside the leakage channel formed between the ducts. In a particular arrangement, the duct sealing member is fixedly mounted on the outside of the motor intake duct and is arranged to form a seal against the inside of the outlet duct. The duct sealing member may be a lip seal. The open end of the inlet duct may fit over the end of the dirty-air duct. The inlet duct sealing member may be fixedly mounted on the outside of the dirty-air duct and be arranged to form a seal against the inside of the inlet duct. The inlet duct sealing member may be in the form of a lip seal.

BRIEF DESCRIPTION OF THE DRAWINGS

Embodiments of the invention will now be described, with reference to the accompanying drawings, in which.

DETAILED DESCRIPTION OF THE INVENTION

Figure 1:
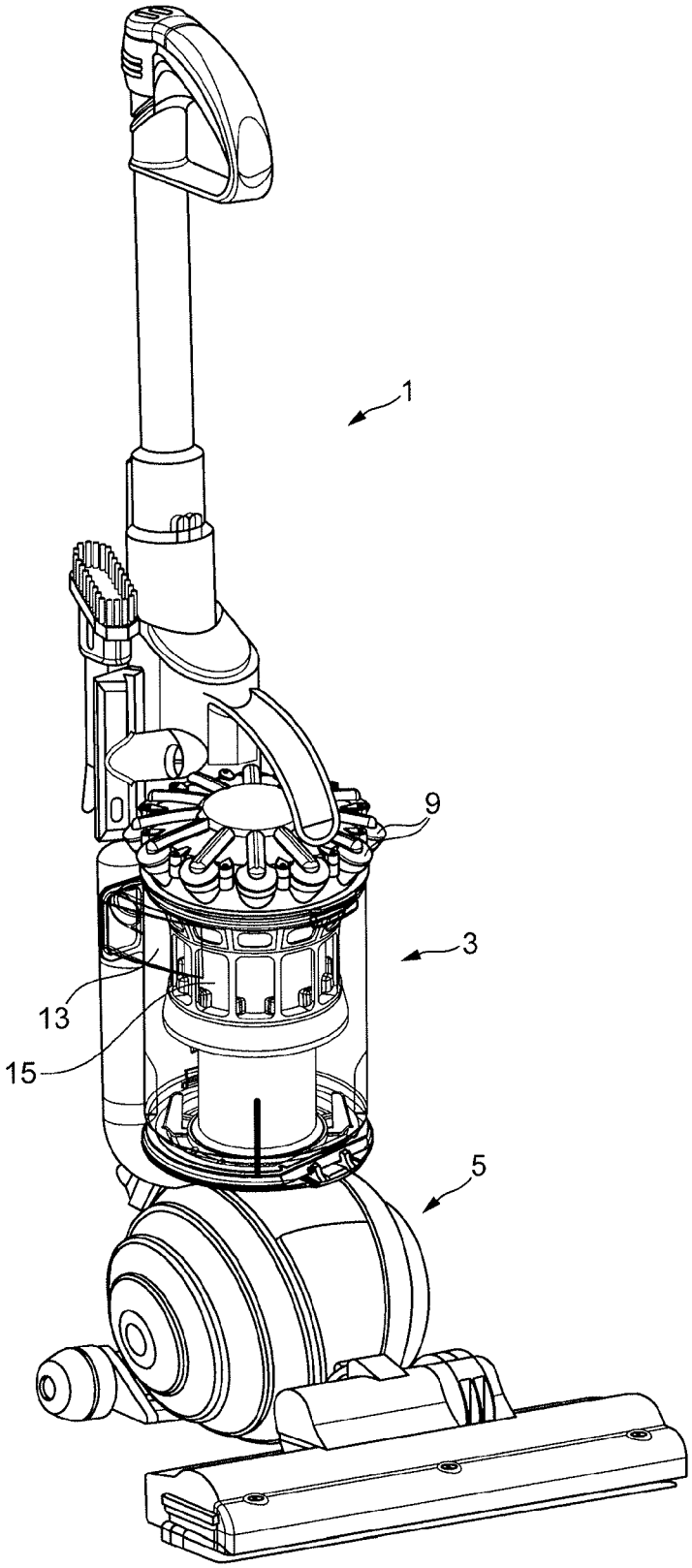
FIG. 1 is a perspective view of a conventional vacuum cleaner.
Figure 3:
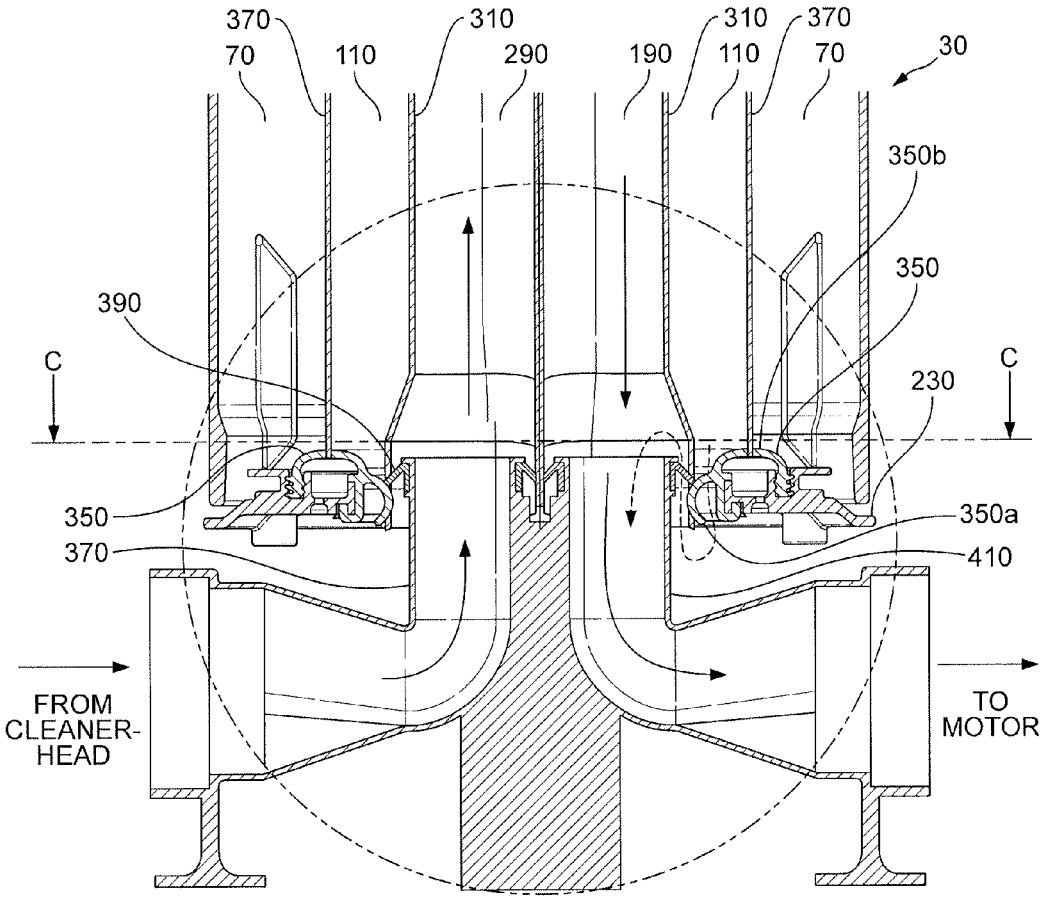
FIG. 3 is a sectional view of the bottom part of a cyclonic separator according to the present invention.
Figure 4:
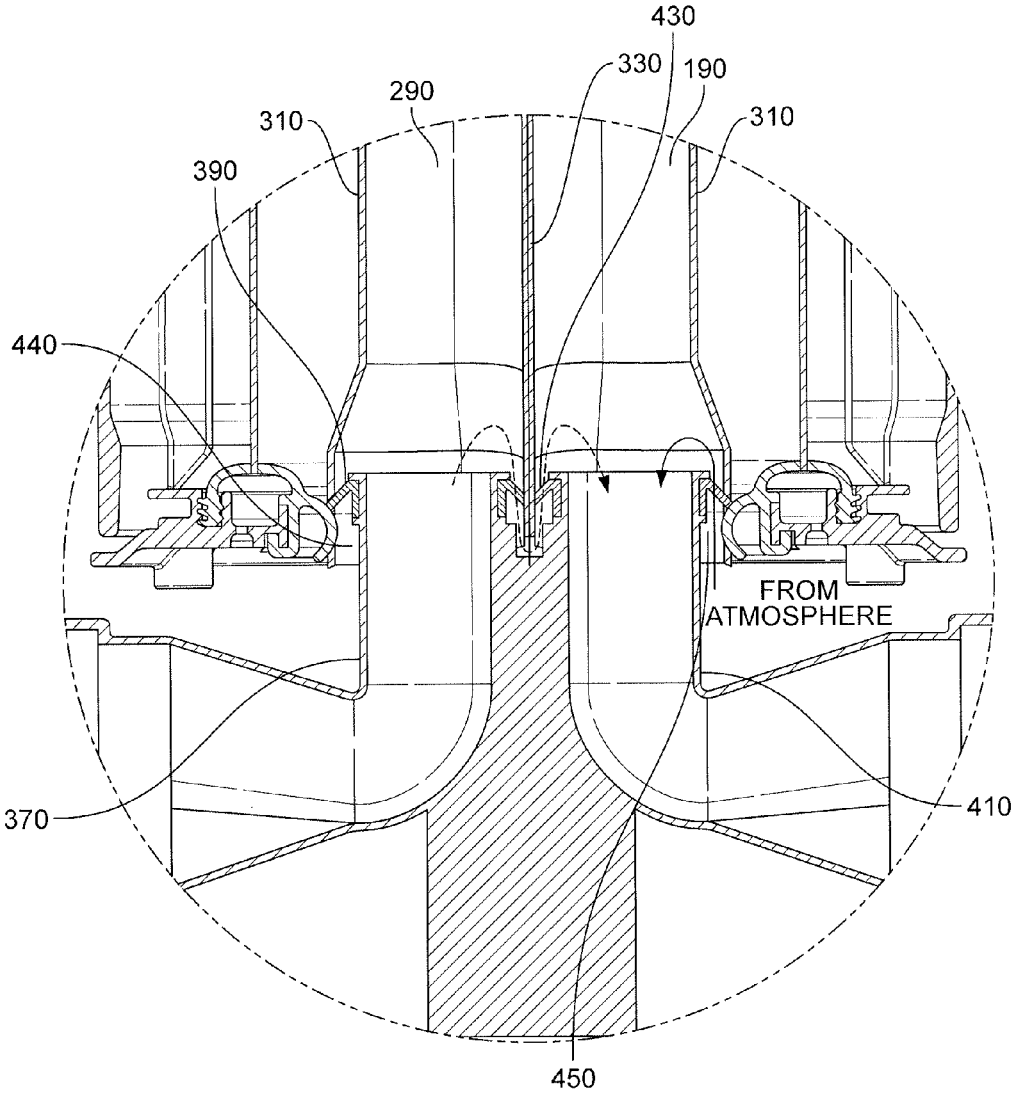
FIG. 4 is a magnified sectional view of the area circled in FIG. 3.
Figure 5:
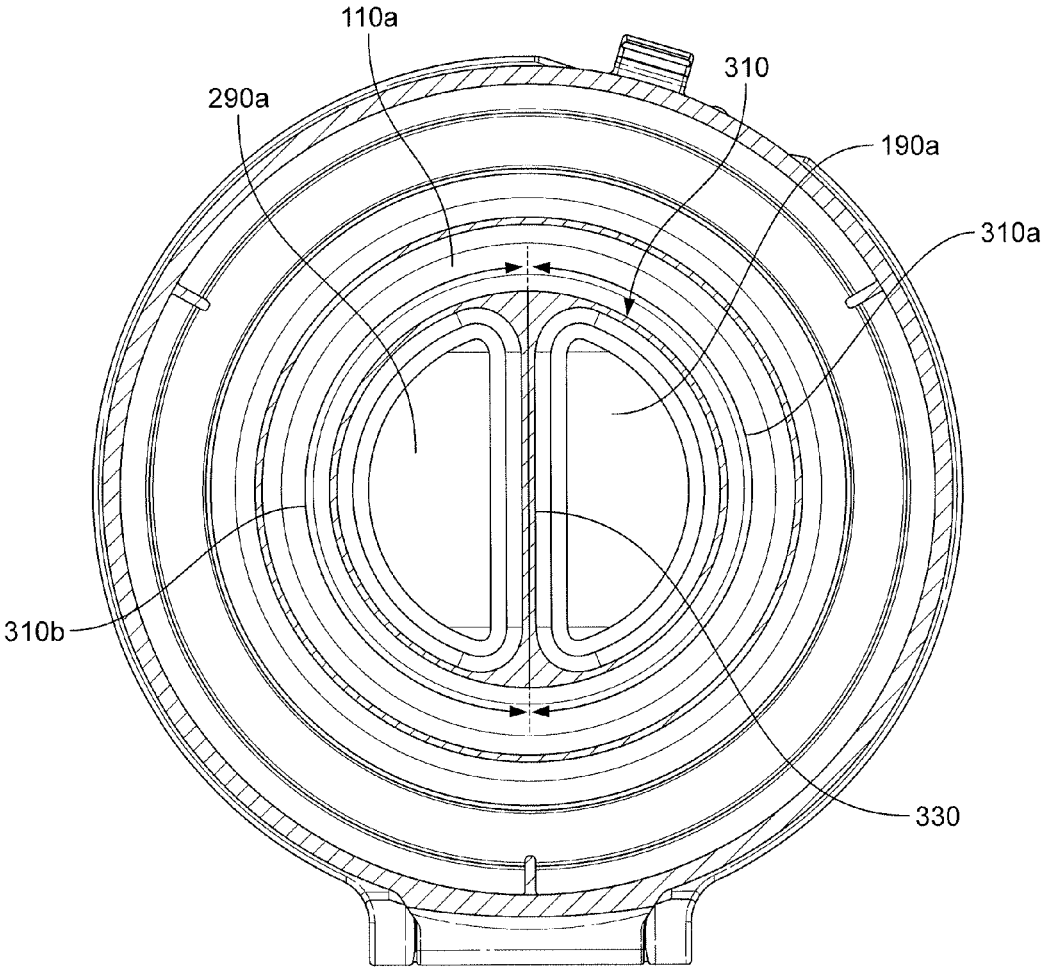
FIG. 5 is a sectional view taken along C-C in FIG. 3.

FIGS. 3 to 5 illustrate the bottom part of a cyclonic separator 30 on a vacuum cleaner in accordance with the invention. Comparing the separator 30 to the conventional separator 3 shown in FIG. 1, the separator likewise comprises an annular, outer cylindrical bin 70 which constitutes the primary cyclone stage, an annular inner dirt collection chamber 110—referred to below as the FDC—which is fed by a respective plurality of second-stage cyclone chambers (not shown) and an outlet duct 190 which takes the air from an exit manifold (not shown) at the top of the cyclone separator 30 and ducts this air down through the base 230 of the cyclonic separator 30, to the motor, as indicated by the arrow.

Figure 2:
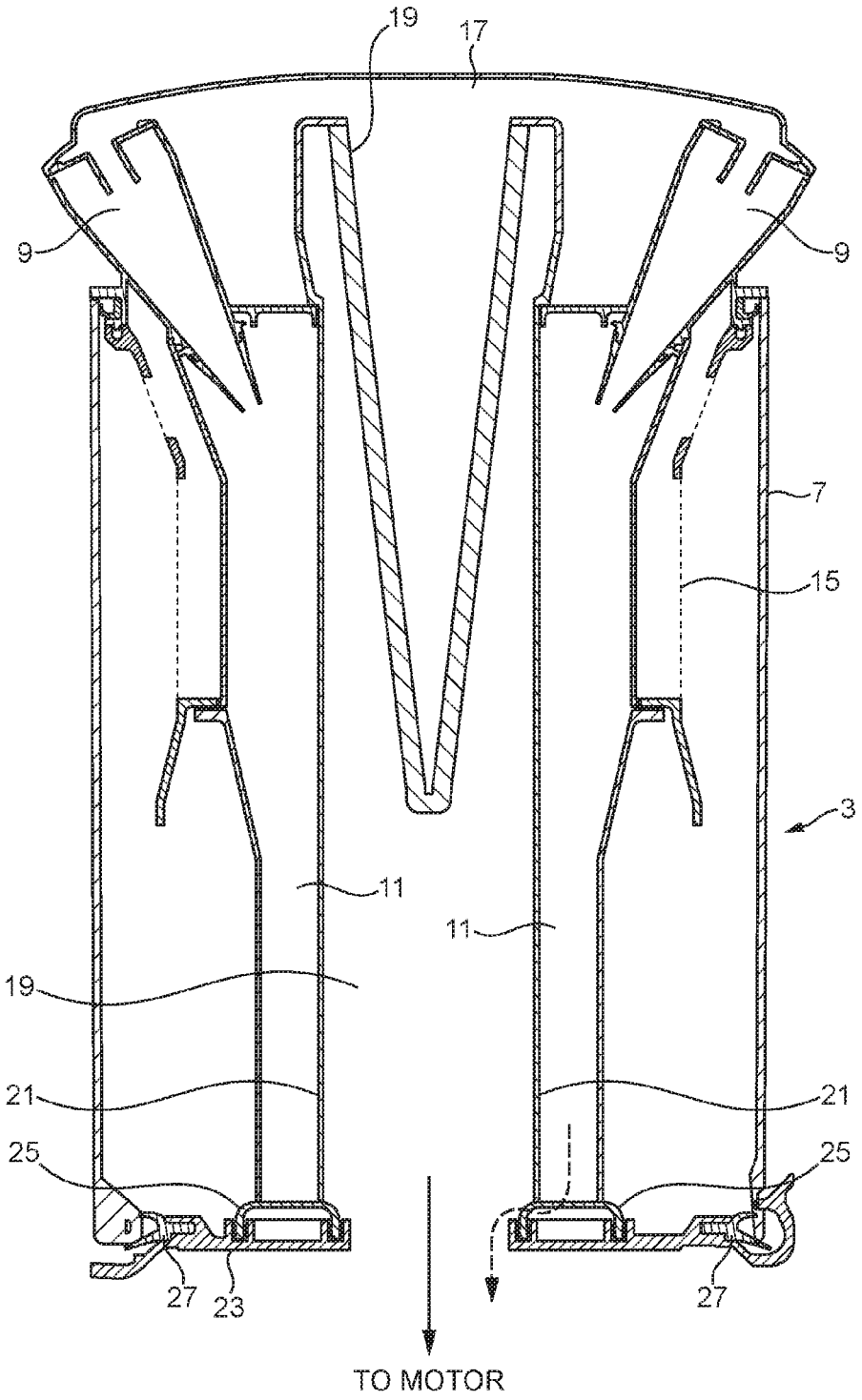
FIG. 2 is a sectional view through a conventional cyclonic separator.

The cyclonic separator 30 differs from the separator shown in FIG. 2 in that the dirty air is also delivered to the primary up through the base of the cyclone separator—again, indicated by an arrow in FIG. 3—so that there is actually also an inlet duct 290 running immediately alongside the outlet duct 190.

The outlet duct 190 shares a section of the circular inner wall 310 with the FDC 110. This common wall section 310*a* divides the open end 190*a* of the outlet duct 190 from the annular open end 110*a* of the FDC 110. The inlet duct 290 likewise shares a section of the circular inner wall 310 with the FDC 110. This common wall section 310*b* divides the open end 290*a* of the inlet duct 290 from the annular open end 110*a* of the FDC 110.

In addition, the inlet duct 290 and the outlet duct 190 together share a common wall section 330, which divides the open ends 190*a*, 290*a* of the ducts 190, 290. This common wall section 330 runs diametrically, so that the two ducts 190, 290 each have a corresponding semi-circular cross section (the corners of the semi-circle are in each case blended to reduce pressure losses), but this is not essential: the common wall section 330 could be arranged along some other chord line of the circular wall 310, for example.

The base 230 takes the form of an annular, hinged cover which is provided to close off the annular open end 110*a* of the FDC 110. The annular area of the cover 230 is such that, in this example, the cover 230 also closes off the annular open end of the outer bin 70. This provides for simultaneous emptying of the FDC 110 and the outer bin 70, but is not essential: a separate cover may be provided for the bin 70.

The circular inner wall 310 of the FDC 110 extends through the central hole in the annular cover 230 when the cover 230 is in the closed position, shown in FIG. 3.

An annular, cover seal member 350 is provided on the upper surface of the cover 230. This cover seal member 350 comprises a flexible sealing lip 350*a* which is arranged to form an air-seal between the cover and the outside surface of the circular wall 310 when the cover 230 is in the closed position. The cover seal member 350 additionally incorporates an annular gasket part 350*b* which seals against the lower end of the outer wall 370 of the FDC 110*a* to form an air-seal between the cover 230 and this outer wall 370. Consequently, the cover 230 seals off the open end of the FDC 110 in the closed position.

The inlet duct 290 slidably engages an up-duct 370 on the vacuum cleaner (a sliding engagement is used so as not to hinder removal of the cyclonic separator 30 from the vacuum cleaner as and when required: the ducts simply slide apart). This up-duct 370 is a dirty-air duct—upstream of the cyclonic separator 30—which ducts dirty air drawn in through the cleaner head to the cyclonic separator 30. An inlet duct sealing member 390 is provided, near the upper end of the dirty-air duct 370, in the form of a flexible lip seal. This lip seal 390 seals against the inside of the inlet duct 290 on the cyclonic separator 30, forming an air-seal between the inlet duct 290 and the dirty-air duct 370.

The outlet duct 190 likewise slidably engages an up-duct 410 on the vacuum cleaner. This second up-duct 410 is a motor intake duct—downstream of the cyclonic separator 30—which ducts clean air exiting the outlet duct 190 to the intake on the main vac-motor. An outlet duct sealing member 430 is provided, near the upper end of the motor intake duct 410, in the form of a flexible lip seal. This lip seal 430 seals against the inside of the outlet duct 190 on the cyclonic separator 30, forming an air-seal between the outlet duct 190 and the motor intake duct 410.

The cover seal member 350 and the outlet duct sealing member 430 act independently from one another. Consequently, both seals are required to fail in order to short circuit the FDC 110 and the motor intake duct 410 (indicated by the dotted arrow in FIG. 3). This is therefore a more reliable sealing arrangement than the conventional sealing arrangement described in FIG. 2.

Similarly, the inlet duct sealing member 390 and the outlet duct sealing member 430 act independently from one another. Consequently, both seals are required to fail in order to short circuit the dirty air duct 370 and the motor intake duct 410 (indicated by the dotted arrow in FIG. 4).

In fact, the specific arrangement described is designed so that a short circuit between the FDC 110 and the motor intake duct 410 is unlikely even in the event of failure of both the cover sealing member 350 and the outlet duct sealing member 430. This is because the motor intake duct 410 connects directly to atmosphere across the air-seal formed by the outlet duct sealing member 430. Consequently, failure of the duct sealing member 430 creates a bypass leakage path (indicated by the solid arrow in FIG. 4) which short-circuits the motor intake duct 410 to atmosphere, bypassing the FDC 110. This significantly reduces dust ingress into the motor intake duct 410 if both sealing members 350, 430 fail, because in effect there is no closed path between the FDC 110 and the motor intake duct 410 across the air-seal formed by the outlet duct sealing member 430.

Similarly, short circuit between the dirty-air duct 370 and the motor intake 410 is unlikely to occur because there is likewise no closed path between the dirty-air duct 370 and the motor intake duct 410: the outlet duct sealing member 430 fails to atmosphere.

The motor intake duct 410 connects to atmosphere via an annular bypass channel 450 which is formed between the wall of the outlet duct 190 and the wall of the motor intake duct 410 extending inside the outlet duct 190. The outlet duct sealing member 430 sits in the bypass channel 450 and, along with the duct walls, effectively forms an annular, open-ended plenum cavity at atmospheric pressure.

In the specific arrangement shown in FIGS. 3 to 5, the dirty-air duct 370 is also connected to atmosphere, via a respective annular bypass channel 470 in similar manner to the motor intake duct 410, so that the dirty-air duct likewise short-circuits to atmosphere if the inlet duct sealing member fails. However, this is not necessary to prevent a closed path forming between the dirty-air duct 370 and the motor intake duct 410 if the motor intake duct 410 is itself connected to atmosphere across the air-seal formed by the outlet duct sealing member 430.

The FDC is additionally connected to atmosphere, across the air-seal formed by the cover sealing member 350, so that the FDC short circuits to atmosphere in the event of failure of the cover sealing member 350. Again, this is not really necessary for preventing a closed path forming between the FDC 110 and the motor intake duct 410 if the motor intake duct 410 is itself connected to atmosphere across the air-seal formed by the outlet duct sealing member 430.

The invention claimed is:

1. A vacuum cleaner comprising a removable dust separator, the dust separator comprising an inlet duct and an outlet duct, the inlet duct being arranged for fluid connection to a dirty-air duct on the cleaner, and the outlet duct being arranged for fluid connection to a motor intake duct on the cleaner, the inlet duct and outlet duct sharing a common wall which divides the open ends of the ducts, an inlet duct sealing member being provided for forming an air-seal between the inlet duct and the dirty-air duct, and an outlet duct sealing member being provided for forming an air seal between the outlet duct and the motor intake duct.

2. The vacuum cleaner of claim 1, in which the open end of the outlet duct is arranged to fit over the end of the motor intake duct.

3. The vacuum cleaner of claim 1, wherein the open end of the outlet duct is arranged to fit over the end of the motor intake duct so as to form a bypass leakage channel between the walls of the ducts, which channel connects the motor intake duct to atmosphere across the air seal formed by the outlet duct sealing member.

4. The vacuum cleaner of claim 3, wherein the outlet duct sealing member sits inside the bypass leakage channel.

5. The vacuum cleaner of claim 4, wherein the outlet duct sealing member is fixedly mounted on the outside of the motor intake duct and forms a seal against the inside of the outlet duct.

6. The vacuum cleaner of claim 5, in which the open end of the inlet duct is arranged to fit over the end of the dirty-air duct.

7. The vacuum cleaner of claim 6, wherein the inlet duct sealing member is fixedly mounted on the outside of the dirty-air duct and forms a seal against the inside of the inlet duct.

8. The vacuum cleaner of claim 1 in which the sealing members are in the form of lip seals.

* * * * *